United States Patent [19]

Gaschler

[11] 4,233,004

[45] Nov. 11, 1980

[54] SEAL FOR AN ECCENTRIC-ROTOR MACHINE

[75] Inventor: Erich Gaschler, Wolfsburg, Fed. Rep. of Germany

[73] Assignee: Volkswagenwerk Aktiengesellschaft, Wolfsburg, Fed. Rep. of Germany

[21] Appl. No.: 17,542

[22] Filed: Mar. 5, 1979

[30] Foreign Application Priority Data

Mar. 6, 1978 [DE] Fed. Rep. of Germany ..... 2809621

[51] Int. Cl.[3] ..... F01C 19/00; F04C 18/10

[52] U.S. Cl. ..... 418/144; 418/61 B

[58] Field of Search ..... 418/61 B, 144

[56] References Cited

U.S. PATENT DOCUMENTS

| | | | |
|---|---|---|---|
| 3,193,186 | 7/1965 | Peras | 418/61 |
| 3,883,276 | 5/1975 | Hofbauer | 418/144 X |

*Primary Examiner*—Herbert Goldstein

*Attorney, Agent, or Firm*—Spencer & Kaye

[57] ABSTRACT

An eccentric-rotor machine includes a housing having a longitudinal axis and defining a plurality of work chambers; radial housing walls bounding the work chambers; a multi-lobe rotor arranged in the housing for orbital motion therein to sequentially and cyclically vary the volume of each chamber in the execution of inward strokes and outward strokes. The rotor has opposite radial rotor walls each defining a clearance with an adjacent respective radial housing wall; and a sealing ring of circular course arranged in the clearance for sealing the work chambers. The sealing ring is concentric to the housing axis and has a diameter so dimensioned that in each chamber a length portion of the sealing ring is situated externally of the outline of the rotor when the volume of the respective chamber is at a maximum. Thus, in each chamber, a length portion of the sealing ring is out of contact with the respective radial rotor wall only during a terminal phase of the outward strokes (such as intake strokes) and a beginning phase of the inward strokes (such as compression strokes) of the rotor.

2 Claims, 2 Drawing Figures

SEAL FOR AN ECCENTRIC-ROTOR MACHINE

BACKGROUND OF THE INVENTION

This invention relates to a seal for an eccentric-rotor machine, such as an eccentric-rotor compressor for sealing the gap between a radial end wall of the chamber housing and a radial end wall of the rotor.

It is known to provide, for the above-outlined purpose, a sealing member which, in top plan view, has the shape of a straight-sided polygon. The number of sides of the polygon is identical to the number of the work chambers and further, each side of the polygon extends between two corner bolts. This conventional construction requires a relatively large radially measured width of the radial rotor walls. The desideratum, however, is a narrow width for the radial rotor walls (that is, a large-diameter central rotor opening), for example, for the purpose of permitting the accommodation of a counterweight and a planetary gear of the machine within the rotor.

SUMMARY OF THE INVENTION

It is an object of the invention to provide an improved seal of the above-outlined type which even in case of narrow radial rotor walls ensures a satisfactory seal whenever required for the particular operational phases of the machine.

This object and others to become apparent as the specification progresses, are accomplished by the invention, according to which, briefly stated, the seal is formed by a sealing ring which is arranged between a radial wall of the chamber housing and the adjacent radial wall of the rotor and is concentric to the axis of the housing and further, the sealing ring has a diameter of such a magnitude that in each chamber a length portion of the sealing ring extends externally of the rotor outline when the chamber volume is at its maximum. This means that in each work chamber, during a terminal phase of the outward stroke (as the chamber volume increases towards a maximum) as well as during an initial phase of the inward stroke (as the chamber volume decreases from a maximum), the sealing ring does not perform a sealing function, but then lies in the work chamber proper.

In the structure of the sealing arrangement according to the invention it is thus intentionally taken into consideration that at least during a terminal phase of the intake cycle and an initial phase of the compression cycle, the seal is not situated between the radial end wall of the respective rotor lobe and the radial end wall of the respective chamber lobe, but is situated in a zone which then constitutes the respective work chamber proper. Such an arrangement provides that not only the usual corner bolts can be dispensed with, but also, the radially measured width of the radial rotor walls may be very small. In the ideal case, the width of the radial rotor walls is only as large as necessitated by the contour of the rotor rim.

DESCRIPTION OF THE PREFERRED EMBODIMENT

Figure 1:
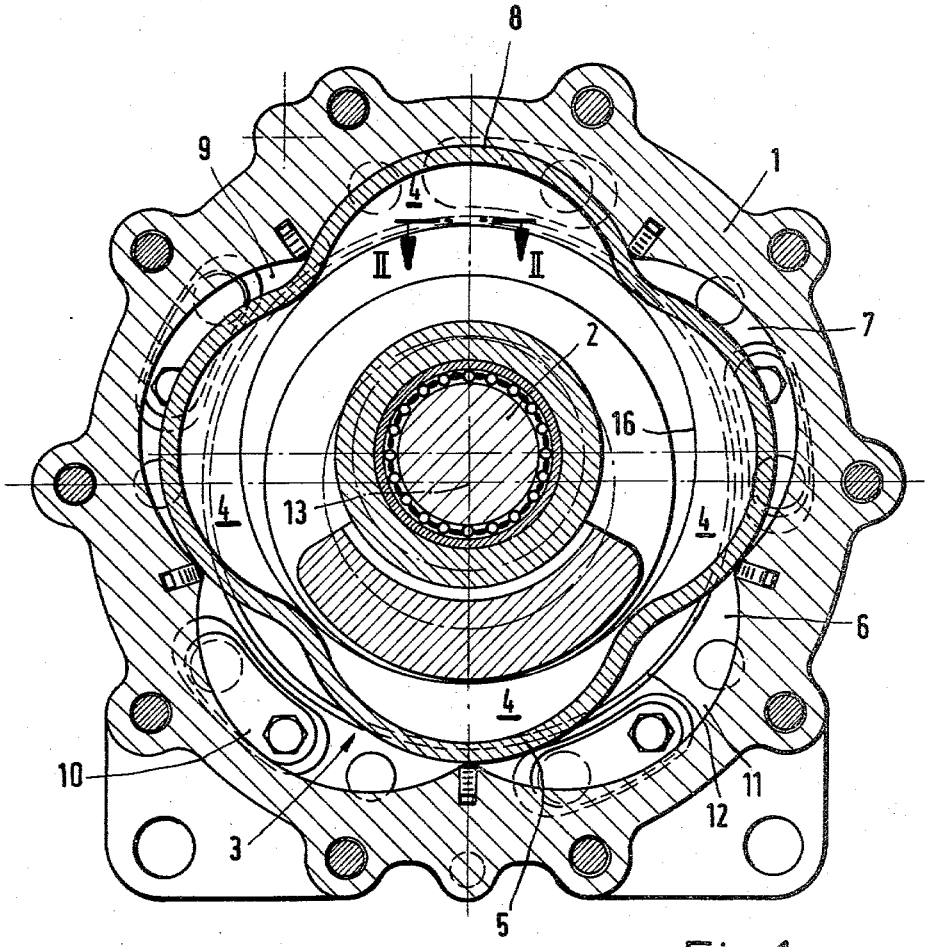
FIG. 1 is a cross-sectional view of an eccentric-rotor machine incorporating a preferred embodiment of the invention.

Turning now to FIG. 1, there is shown, in cross-sectional illustration, an eccentric-rotor machine which may be used as a compressor in an air-conditioning system. The rotary machine has a housing 1 defining a five-lobe work chamber arrangement. The work chamber arrangement is closed by a frontal radial wall (not shown) and a rear radial wall 11. In the five-lobe chamber arrangement, there is accommodated a four-lobe rotor 3 driven by an eccentric shaft 2. During operation, the eccentric shaft 2 circulates the rotor 3 which, as it orbits about the housing axis 13, rolls successively into and out of the chamber lobes.

The rotor 3 is of annular construction. It has a frontal radial end wall (not shown) and a rear radial end wall 4 as well as an undulating rotor rim 5. The plane of the front and rear radial walls are perpendicular to the rotor axis. The outer face of the radial rotor wall 4 (that is, the face which is turned away from the observer in FIG. 1) is oriented towards the inner face of the radial end wall 11 (that is, the face which is turned towards the viewer in FIG. 1). The rotor lobes as well as the chamber lobes together define five work chambers 6, 7, 8, 9 and 10 whose volume, dependent upon the position of the orbiting eccentric rotor 3, varies between minimum and maximum values. The inner periphery of the radial end wall 4 of the rotor 3 is designated at 16. The periphery 16 is thus the boundary of the central rotor opening.

For sealing the clearance defined between the inner face of the radial housing wall 11 and the outer face of the radial rotor wall 4, there is provided a sealing ring 12 which is concentric with respect to the housing axis 13. The diameter of the sealing ring 12 is so selected that for each work chamber a length portion of the sealing ring associated with the respective work chamber is not situated at all times in a sealing relationship between the facing radial walls 4 and 11. Thus, considering the illustrated position of the rotor 3 for the chambers 6 and 10, a length portion of the sealing ring 12 in both chambers 6 and 10 is situated externally of the rotor outline. In case of chamber 8, where the volume is at a minimum and chambers 7 and 9, where the volume is appreciably less than in case of chamber 6 or 10, the sealing ring portions associated with the chambers 7, 8 and 9 are in their entirety within the outline of the rotor and thus perform their intended sealing function between the radial rotor wall 4 and the radial housing wall 11. Thus, stated differently, in each chamber during a terminal phase of the outward stroke (the chamber volume increases and reaches a maximum) and during a beginning phase of the inward stroke (the chamber volume decreases from the maximum) a length portion of the sealing ring 12 lies externally of the rotor outline. This means that during these operational periods the sealing ring in the respective work chamber does not function as a seal, but is then situated in the work chamber proper. On the other hand, in the operational phases when the sealing ring is required to perform its above-described sealing function, namely, e.g. during the terminal part of the compression stroke and the initial part of the intake stroke as depicted for work chambers 7, 8 and 9 (that is, in operational phases where overpressure prevails in the respective work chambers), the respective length portions of the sealing ring 12 are, as described above, situated in their entirety within the outline of the rotor to thus perform their intended sealing function.

Figure 2:
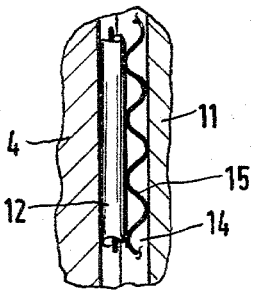
FIG. 2 is a fragmentary sectional view taken along line II—II of FIG. 1.

Turning now to FIG. 2, a groove 14 of circular course is provided in the inner face of the radial housing wall 11. The sealing ring 12 nests in the groove 14, but projects outwardly therefrom to engage the outer face of the radial rotor wall 4. Between the bottom of the groove 14 and the sealing ring 12 there is arranged a resilient element 15 which resiliently resists the forces that urge the sealing ring 12 deeper into the groove 14.

It is to be understood that the same type of seal may be provided between the non-illustrated frontal radial housing wall and the frontal radial rotor wall.

It is seen that the radially measured width of the radial rotor wall 4 is held at a minimum since the diameter of the inner periphery 16 can, by virtue of the invention, assume a maximum value determined solely by the configuration of the rotor lobes. There is thus obtained an optimally large central rotor opening, resulting in a reduction of the rotor weight, economy of material and maximum useful space within the rotor.

A material suitable for sealing ring 12 is cast iron. In the example shown in the drawing, the maximum diameter of rotor 3 is 103 mm, the inner diameter of sealing ring 12 is 88 mm, its outer diameter is about 90.2 mm and its height is about 2.5 mm.

It is to be understood that the above description of the present invention is susceptible to various modifications, changes and adaptations and the same are intended to be comprehended within the meaning and range of equivalents of the appended claims.

What is claimed is:

1. In an eccentric-rotor machine including a housing having a longitudinal axis and defining a plurality of work chambers; radial housing walls bounding the work chambers; a multi-lobe rotor arranged in the housing for orbital motion therein to sequentially and cyclically decrease and increase the volume of each chamber in the execution of inward and outward strokes, respectively; the rotor having opposite radial rotor walls each defining a clearance with an adjacent respective radial housing wall; and sealing means arranged in the clearance for sealing the work chambers; the improvement wherein said sealing means comprises a sealing ring of circular course; said sealing ring being concentric to said axis and having a diameter such that in each chamber a length portion of said sealing ring is situated externally of the outline of the rotor when the volume of the respective chamber is at a maximum, whereby said length portion is out of contact with the respective radial rotor wall during a terminal phase of the outward strokes and a beginning phase of the inward strokes of said rotor and said length portion is in contact with said respective radial rotor wall during a beginning phase of the outward strokes and a terminal phase of the inward strokes.

2. An eccentric-rotor machine as defined in claim 1, further comprising means defining a groove of circular course in the housing wall bounding said clearance; said sealing ring being accommodated in said groove; and resilient means arranged in said groove underneath said sealing ring for resiliently resisting forces urging said sealing ring into said groove.

* * * * *